United States Patent [19]

Kerawalla et al.

[11] Patent Number: 5,076,810

[45] Date of Patent: Dec. 31, 1991

[54] FABRICS OF POLYESTER COPOLYMER FIBERS: DYEING THE HEAT SET FABRIC

[75] Inventors: Jal N. Kerawalla, Greenville, N.C.; Veronika S. Foldi, Wilmington, Del.

[73] Assignee: E. I. Du Pont de Nemours and Company, Wilmington, Del.

[21] Appl. No.: 575,108

[22] Filed: Aug. 29, 1990

[51] Int. Cl.[5] ..... D06P 7/00; D01D 5/22

[52] U.S. Cl. ..... 8/494; 8/497; 8/922; 264/168

[58] Field of Search ..... 8/494

[56] References Cited

U.S. PATENT DOCUMENTS

| | | | |
|---|---|---|---|
| 2,071,251 | 2/1937 | Carothers | 8/130.1 |
| 2,465,319 | 3/1949 | Whinfield et al. | 8/130.1 |
| 3,018,272 | 1/1962 | Griffing et al. | 8/512 |
| 3,385,831 | 5/1968 | Watson | 528/305 |
| 3,816,486 | 6/1974 | Vail | 528/305 |

*Primary Examiner*—A. Lionel Clingman

[57] ABSTRACT

Improved fabrics of fibers of a copolymer of ethylene terephthalate/hexahydroterephthalate containing a high proportion of hexahydroterephthalate are obtained by processing the fabrics and fibers within critical temperature ranges.

2 Claims, No Drawings

FABRICS OF POLYESTER COPOLYMER FIBERS: DYEING THE HEAT SET FABRIC

FIELD OF INVENTION

This invention concerns improvements in the processing of fibers and fabrics of a particular copolymer, namely an ethylene terephthalate/hexahydroterephthalate copolymer of 80–86 mol % terephthalic acid/20–14 mol % hexahydroterephthalic acid components, whereby such fabrics are provided with superior properties, especially aesthetics, and the resulting fabrics.

BACKGROUND OF THE INVENTION

Synthetic polyester fibers have been known and used commercially for several decades, having been first suggested by W. H. Carothers, U.S. Pat. No. 2,071,251, and then by Whinfield and Dickson, U.S. Pat. No. 2,465,319. Most of the polyester polymer that has been manufactured and used commercially has been poly(ethylene terephthalate), sometimes referred to as 2G-T. This polymer is often referred to as homopolymer. Commercial homopolymer is notoriously difficult to dye. Such homopolymer is mostly dyed with disperse dyestuffs at high temperatures under elevated pressures, which is a relatively expensive and inconvenient process (in contrast to processes for dyeing several other commercial fibers at atmospheric pressure, e.g. at the boil), and so there have been several suggestions for improving the dyeability of polyester yarns. For instance, Griffing and Remington, U.S. Pat. No. 3,018,272, suggested the use of cationic-dyeable polyesters. Such polyesters, consisting essentially of poly [ethylene terephthalate/5-(sodium sulfo) isophthalate] containing about 2 mol % isophthalate groups in the polymer chain (2G-T/SSI), have been used commercially as a basis for polyester yarns for some 20 years.

Although such polyester fibers have been very useful, it has long been desirable to provide alternative fibers, having the desirable characteristics of commercial polyester fibers accompanied by excellent dyeing properties.

Watson, in U.S. Pat. No. 3,385,831, suggested textile fibers of copolymers of polyethylene terephthalate/hexahydroterephthalate. These fibers showed a surprising combination of enhanced dyeability and good overall physical properties, including low shrinkage values. These copolymer fibers are rather unique, considering the unusually large molar amounts of comonomer (i.e. the hexahydroterephthalate units, HT) in comparison with other comonomers in polymers with ethylene terephthalate (2G-T). Despite the advantages on paper, however, Watson's fibers were not produced in commercial quantities. Some reasons are believed to be the relatively poor aesthetics and relatively high sensitivity to elevated temperatures of Watson's fibers, especially when processed in the form of fabrics. As indicated, several properties do get less desirable as the proportion of comonomer is increased, although the dyeability is correspondingly improved. The improved dyeability from higher proportions of HT comonomers would have been very desirable, if certain problems could have been solved, with regard to fabric aesthetics, especially.

An object of the present invention is to improve the properties of Watson's type of fibers of copolymers containing ethylene terephthalate (2G-T) and ethylene hexahydroterephthalate (2G-HT) units, especially in the textile fabrics in which form they are ultimately used.

BRIEF SUMMARY OF THE INVENTION

According to one aspect of the invention, there is provided a process for preparing a dyed fabric of fibers of ethylene terephthalate/hexahydro terephthalate copolymer of 80–86 mol percent terephthalic acid/20–14 mol percent are heat set within a temperature range of about 160° to about 180° C. before dyeing.

According to another aspect of the invention, the resulting fabrics are also provided.

DETAILED DESCRIPTION OF THE INVENTION

The particular copolymers and many of the details of their preparation and processing, in the form of fibers and fabrics, are described in Watson, U.S. Pat. No. 3,385,831, the disclosure of which is hereby specifically incorporated by reference. However, according to the present invention, it has proved possible to improve the properties of the fibers sufficiently so that the molar proportion may be as high as about 20 mol % of the hexahydroterephthalate(HT) comonomer component, i.e. about 12–20 mol % may be used, about 16–18% being preferred, especially about 17%. It is most unusual to find a satisfactory polymer of such high comonomer content, and much of the art prescribes that the amount should not exceed 15 mol%. Indeed, as indicated, as little as 2 mol % is used commercially for the 2G-T/SSI fiber.

Preferred processing conditions for conventional polyester filaments have been disclosed in the art, e.g. Vail U.S. Pat. No. 3,816,486, the disclosure of which is also hereby specifically incorporated by reference. Generally, the apparatus described and illustrated by Vail may be used to prepare filaments for use according to the present invention, subject to the comments herein. In particular, Vail's recommendations about temperatures should be modified, as noted herein. Indeed, processing according to the present invention must be carried out between critical temperature limits, as indicated herein and in copending Applications Ser. No. 575,107 filed Aug. 29, 1990 and Ser. No. 575,109 filed Aug. 29, 1990, filed by Hansen simultaneously herewith, the disclosures of which are hereby specifically incorporated by reference. As will be understood by those skilled in the art, however, the precise temperature limits will always depend on the actual fibers and conditions chosen, e.g. the polymer viscosity, in particular.

The invention is further illustrated in the following Examples. The preparation of the annealed fibers was carried out using carefully controlled temperatures, essentially as described in the copending application DP-4460,simultaneously filed by Hansen, in contrast with what was taught by Watson, in U.S. Pat. No. 3,385,831.

EXAMPLE

A random copolymer (LVR=24.5) of 83 mole % polyethylene terephthalate and 17 mole % polyethylene hexahydroterephthalate, prepared by ester interchange and polycondensation reactions, was spun in a conventional manner, using a spinneret temperature of 285° C. and a wind-up speed of 1,450 yd./min., to produce a yarn of 900 filaments (round) having a total denier of 2,904. Between the spinneret and the wind up, the yarn contacted a finish roll which applied to the filaments a finish composed of 3.5% (by weight) aqueous emulsion of an anionic surfactant and a nonionic lubricant and wherein 1.6% (by weight) sodium hydroxide was dissolved in the aqueous phase. The wet pick-up of finish on the yarn was about 4% (by weight).

Bundles of yarn were collected together to form a tow of about 54,000 denier from which staple fibers were prepared via drawing, heat treatment, crimping, drying, and cutting, as follows.

The tow was passed through a series of feed rolls through water at 45° C. to a series of draw rolls (peripheral speed of 55 yd./min.) to produce a first stage draw ratio of 2.22X. The fibers were further drawn at 1.25X to give a total draw of 2.78X and were then sprayed with water at an elevated temperature. The drawn tow was then passed to a series of electrically-heated rolls, that heated the tow, under tension, for 8 seconds. The fibers were relaxed 10% during the heating process. A fiber finish was applied to the fibers which were crimped in a stuffer box crimper wherein steam (15 psig) was introduced during crimping. The crimped fibers were dried in an oven at 70° C. for 8 minutes. The tow was cut to 1½ inch staple in a conventional manner.

The fiber thus obtained had a nominal denier of 1.3 denier per filament, a tenacity (T) of 5.2 g./den., an elongation (E) of about 18%, about 9 crimps/inch, a dry heat shrinkage (180° C.) of roughly 10%, and a boil-off shrinkage of 1.2%.

This example illustrates carrier-free dyeing of woven fabric from the fiber described above. As will be seen, soft, supple fabrics were obtained when the greige fabrics were pre-treated by heat-setting before dyeing, but not when this pre heat-setting was omitted.

Fabrics

A 35/1 cc spun yarn was prepared and woven into two plain weave fabrics with loom constructions of 87 ends ×56 picks and 87 ends ×66 picks. Four samples (each 16 yd. in length) were cut from each fabric and coded:

87×56 : samples 1D, 1E, 1F, 1G

87×66 : samples 2D, 2E, 2F, 2G.

All eight samples were given an open-width scour at 160° F./20 min. (2 passes) in a bath containing Merpol* HCS surface active agent (E.I. du Pont de Nemours & Co.) and trisodium phosphate, each present at 2 g./l. concentration. The samples were dried at 250° F. at about wet width (49 inches and no overfeed), then processed as described below.

Heat-Set Samples

Scoured samples 1G, 2G, 1F, and 2F were heat-set at 350° F./30 sec. at about one half inch under dry width (48 ¾ inches).

Sample Dyeing

Pressure Dyeing

Heat-set samples 1F and 2F and scoured/dried samples 1D and 2D were placed in a commercial pressure dyeing vessel containing an aqueous solution of Merpol* HCS (conc. =0.5 g./l.) and heated at 160° F./20 min. The treatment bath was cleared, a fresh bath prepared at 130° F./Merpol* HCS (conc. =1% on weight of fabric) and the fabrics were treated for 10 minutes therein. Eastman's disperse dye Poly Blue GLF was added (conc. =2% on weight of fabric), the pH adjusted to 5–5.5 (acetic acid), the bath temperature gradually raised to 250° F. and kept thereat for 1 hr. The temperature was reduced to 170° F., the vessel depressurized, the bath cleared, and the dyed samples removed.

Atmospheric Dyeing

Heat-set samples 1G and 2G and scoured/dried samples 1E and 2E were placed in an 18 inch Beck Dyer and given a pre-dyeing scour in the manner of the pressure-dyed samples, above. The treatment bath was cleared, a fresh bath prepared, and the samples treated therein for 5 min., all as for the pressur-dyed samples, above. The Poly Blue GLF dye was added before, the pH adjusted to 5.3–5.5 (acetic acid), the bath temperature raised graudally to boiling and kept thereat for 2 hr. The temperature was allowed to cool to 170° F., the bath cleared, and the dyed samples removed.

Post-Dyeing Treatment

Samples 1F and 2F (heat-set/pressure-dyed) and samples 1G and 2G (heat-set/atmospherically-dyed) were dried at 250° F. at about their heat-set width (48½ inches).

Samples 1D and 2D (pressure-dyed) and samples 1E and 2E (atmospherically-dyed) were dried at 250° F. at about one half inch less than their wet width, then heat-set at 350° F. at one half inch less than their wet width.

Fabric Evaluation

Finished samples 1F, 2F, 1G, and 2G were soft, supple, draped well, and exhibited deep, even dyeing. While exhibiting similar uniform color, finished samples 1D, 2D, 1E, and 2E were stiff and boardy and less pill-resistant than samples 1F, 2F, 1G and 2G. Thus, the pre-heat set samples were superior to the others and were appropriate for use in apparel. In addition to the much better aesthetics obtained, it is surprising that in a competitive dyeing at atmospheric pressure without carrier, the pre-heat treatment of these samples did not adversely affect their dyeability.

Comparable treatments of fabrics woven from scalloped-oval cross section and from cruciform cross section fibers prepared from this copolymer exhibited essentially equivalent properties when treated as described above.

The pre-dyeing heat setting conditions described above should be kept within carefully controlled limits, for instance, a temperature range of 325° to 360° F. (about 160° to about 180° C.) and for periods of up to about 1 minute, according to the temperature chosen and according to the other conditions, as indicated.

These fabrics possess a unique combination of good dyeability with good aesthetics, with dye shades that are good even after relatively rigorous thermal pretreatment (within the recommended limits). So, the fibers of these particular copolymers, when processed according to the process of the present invention provide advantages that are quite unique, as compared with existing commercially available fibers.

We claim:

1. Process for preparing a dyed fabric of fibers of ethylene terephthalate/hexahydroterephthalate copolymer of 80–86 mol percent terephthalic acid/20–14 mol percent hexahydroterephthalic acid components, comprising the steps, sequentially, of first forming a fabric of said fibers, then subjecting said fabric to heat setting within a temperature range of about 160° C. to about 180° C. followed by dyeing the heat-set fabric.

2. Process according to claim 1, wherein the copolymer is of 16–18 mol % hexahydroterephthalic acid components and 82–84 mol % terephthalic acid components.

* * * * *